US010723542B1

(12) United States Patent
Newman

(10) Patent No.: US 10,723,542 B1
(45) Date of Patent: Jul. 28, 2020

(54) BINDING STRIP STORING AND DISPENSING DEVICE

(71) Applicant: Cheryl Newman, Titusville, FL (US)

(72) Inventor: Cheryl Newman, Titusville, FL (US)

( * ) Notice: Subject to any disclaimer, the term of this patent is extended or adjusted under 35 U.S.C. 154(b) by 0 days.

(21) Appl. No.: 16/538,642

(22) Filed: Aug. 12, 2019

(51) Int. Cl.

| | |
|---|---|
| ***B65D 43/22*** | (2006.01) |
| ***B65D 83/08*** | (2006.01) |
| ***B65D 43/16*** | (2006.01) |
| ***B65D 25/28*** | (2006.01) |
| ***B65D 25/20*** | (2006.01) |

(52) U.S. Cl.
CPC ..... *B65D 83/0805* (2013.01); *B65D 25/205* (2013.01); *B65D 25/2867* (2013.01); *B65D 43/166* (2013.01); *B65D 43/22* (2013.01); *B65D 2203/02* (2013.01); *B65D 2583/082* (2013.01)

(58) Field of Classification Search
USPC ..... 221/33–63
See application file for complete search history.

(56) References Cited

U.S. PATENT DOCUMENTS

| | | | | |
|---|---|---|---|---|
| 3,827,654 A | | 8/1974 | Armstrong | |
| 3,986,479 A | * | 10/1976 | Bonk | B65D 83/0805 118/506 |
| 4,008,806 A | | 2/1977 | de Paez | |
| 4,081,154 A | | 3/1978 | Miszkwitz, Jr. | |
| 4,330,095 A | | 5/1982 | Carter | |
| 5,439,104 A | * | 8/1995 | Wolska-Klis | G02C 13/006 206/233 |
| 5,542,568 A | * | 8/1996 | Julius | B65D 83/0805 221/63 |
| 5,975,458 A | | 11/1999 | Goldthreate | |
| 6,189,729 B1 | | 2/2001 | Keller | |
| D466,732 S | | 12/2002 | Ball | |
| 6,508,380 B1 | * | 1/2003 | von Schuckmann | B65D 83/0835 221/155 |
| 2001/0019064 A1 | * | 9/2001 | Jacques | A47K 10/421 221/63 |
| 2002/0179626 A1 | * | 12/2002 | Huang | B65D 83/0805 221/63 |
| 2007/0272635 A1 | | 11/2007 | Cuadra | |
| 2007/0278242 A1 | * | 12/2007 | Amundson | A47K 10/421 221/63 |
| 2011/0011879 A1 | * | 1/2011 | Johnson | A47K 10/422 221/45 |
| 2012/0152974 A1 | * | 6/2012 | Gordon | A47K 10/421 221/45 |
| 2012/0160864 A1 | * | 6/2012 | Shoaf | A47K 10/421 221/45 |

(Continued)

*Primary Examiner* — Gene O Crawford
*Assistant Examiner* — Ayodeji T Ojofeitimi

(57) ABSTRACT

A binding strip storing and dispensing device for organizing and dispensing binding strips for quilting includes a box and a lid. The box has a top that is open and configured for insertion of a plurality of binding strips, which are used in binding quilts, into the box. The lid is hingedly coupled to the box and is selectively couplable to the box so that the lid is positioned to selectively close the top to contain the binding strips. A set of slots is positioned in the lid. Each slot is configured to allow extension of a respective binding strip from the lid, wherein the respective binding strip is positioned for grasping in a hand of a user, positioning the user for pulling a desired length of the respective binding strip through the slot.

14 Claims, 4 Drawing Sheets

(56) References Cited

U.S. PATENT DOCUMENTS

| | | | | |
|---|---|---|---|---|
| 2014/0191075 | A1 | 7/2014 | Gardelli | |
| 2015/0297041 | A1* | 10/2015 | Piron | B65D 5/6676 221/282 |

* cited by examiner

BINDING STRIP STORING AND DISPENSING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relate to storing and dispensing devices and more particularly pertain to a new storing and dispensing device for organizing and dispensing binding strips for quilting.

BRIEF SUMMARY OF THE INVENTION

An embodiment of the disclosure meets the needs presented above by generally comprising a box and a lid. The box has a top that is open and configured for insertion of a plurality of binding strips, which are used in binding quilts, into the box. The lid is hingedly coupled to the box and is selectively couplable to the box so that the lid is positioned to selectively close the top to contain the binding strips. A set of slots is positioned in the lid. Each slot is configured to allow extension of a respective binding strip from the lid, wherein the respective binding strip is positioned for grasping in a hand of a user, positioning the user for pulling a desired length of the respective binding strip through the slot.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
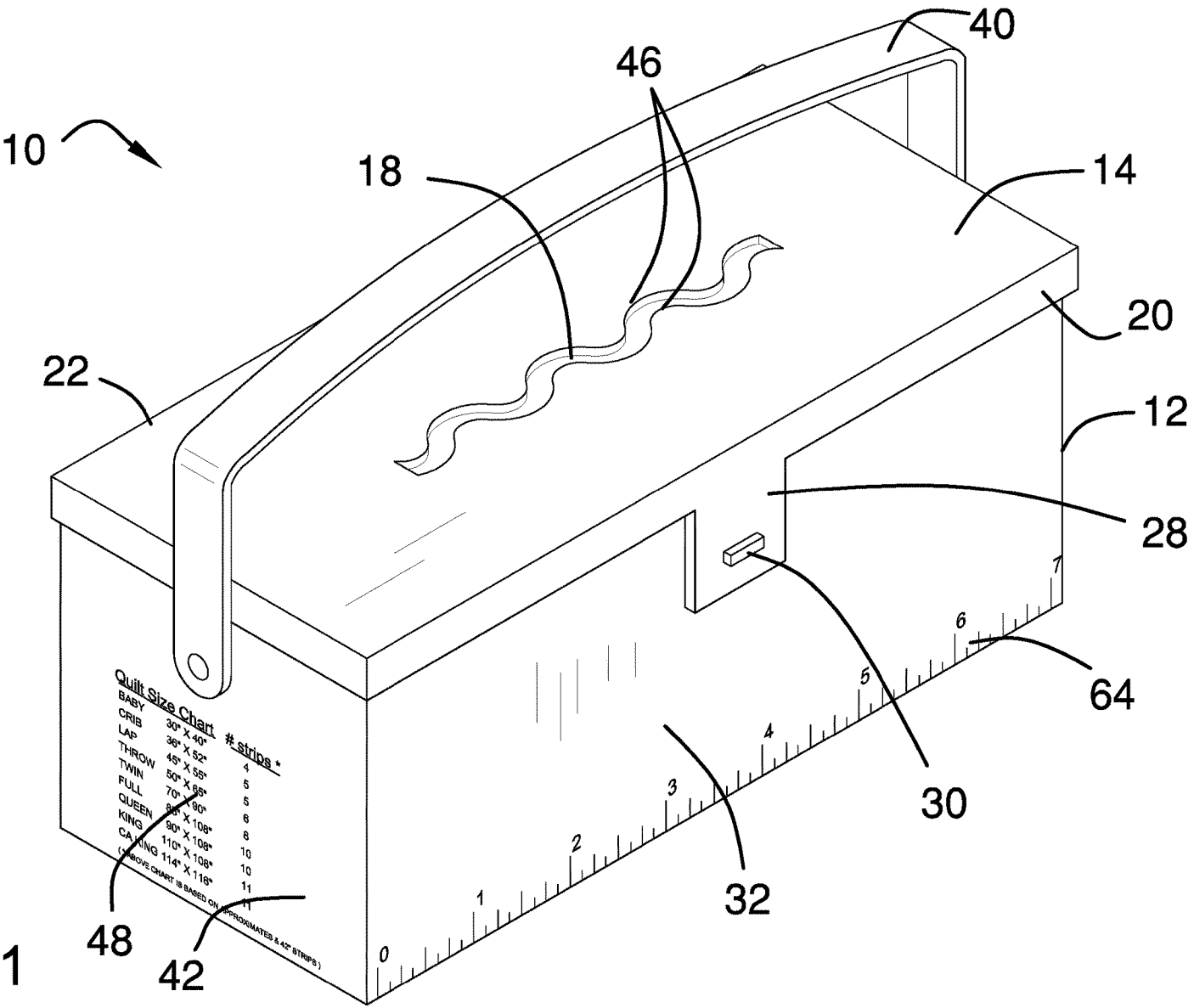
FIG. 1 is an isometric perspective view of a binding strip storing and dispensing device according to an embodiment of the disclosure.
Figure 2:
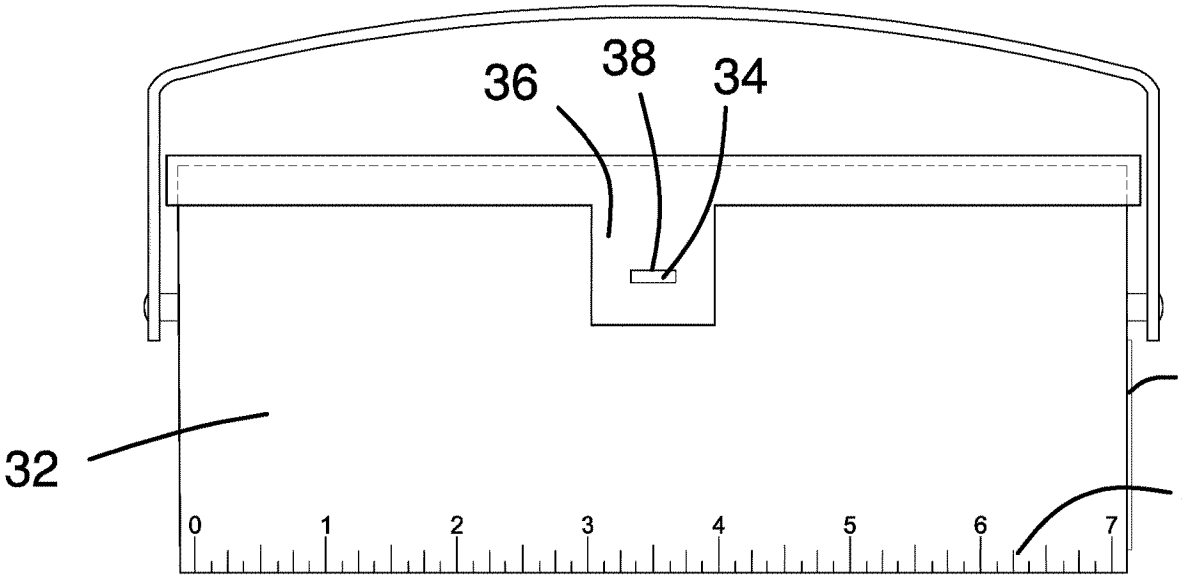
FIG. 2 is a front view of an embodiment of the disclosure.
Figure 3:
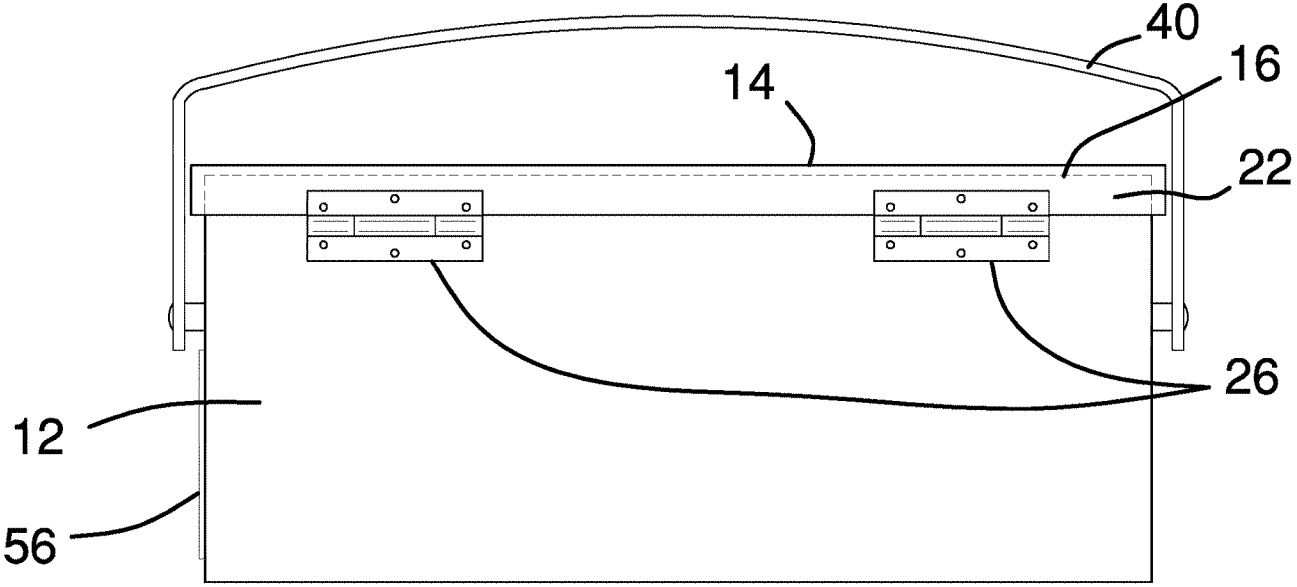
FIG. 3 is a rear view of an embodiment of the disclosure.

With reference now to the drawings, and in particular to FIGS. 1 through 6 thereof, a new storing and dispensing device embodying the principles and concepts of an embodiment of the disclosure and generally designated by the reference numeral 10 will be described.

As best illustrated in FIGS. 1 through 6, the binding strip storing and dispensing device 10 generally comprises a box 12 and a lid 14. The box 12 has a top 16 that is open and configured for insertion of a plurality of binding strips, which are used in binding quilts, into the box 12. The lid 14 is hingedly coupled to the box 12 and is selectively couplable to the box 12 so that the lid 14 is positioned to selectively close the top 16 to contain the binding strips.

A set of slots 18 is positioned in the lid 14. Each slot 18 is configured to allow extension of a respective binding strip from the lid 14, wherein the respective binding strip is positioned for grasping in a hand of a user, positioning the user for pulling a desired length of the respective binding strip through the slot 18.

The set of slots 18 may comprise a single slot 18 that is positioned substantially equally distant from a forward edge 20 and rearward edge 22 of the lid 14, as shown in FIG. 1. The slot 18 is configured to allow extension of each binding strip of the plurality of binding strips. The slot 18 extends sinuously from proximate to opposing side edges 24 of the lid 14.

Each of a set of hinges 26 is coupled to and extends between the box 12 and the rearward edge 22 of the lid 14 so that the lid 14 is hingedly coupled to the box 12. The set of hinges 26 comprises two hinges 26.

A first fastener 28 is coupled to the forward edge 20 of the lid 14. A second fastener 30 is coupled to a front 32 of the box 12. The second fastener 30 is complementary to the first fastener 28 so that the second fastener 30 is positioned to be selectively coupled to the first fastener 28 to secure the lid 14 to the box 12.

The second fastener 30 comprises a protrusion 34 and the first fastener 28 comprises a tab 36 and a hole 38, or other combination of fastening means, such as, but not limited to, clasps, buckles, hook and loop fasteners, and the like. The tab 36 is resiliently bendable. The hole 38 is positioned in the tab 36 and is complementary to the protrusion 34. The tab 36 is coupled to and extends from the forward edge 20 and thus is configured to be bent so that the hole 38 is positioned to selectively insert the protrusion 34 to secure the lid 14 to the box 12.

Figure 4:
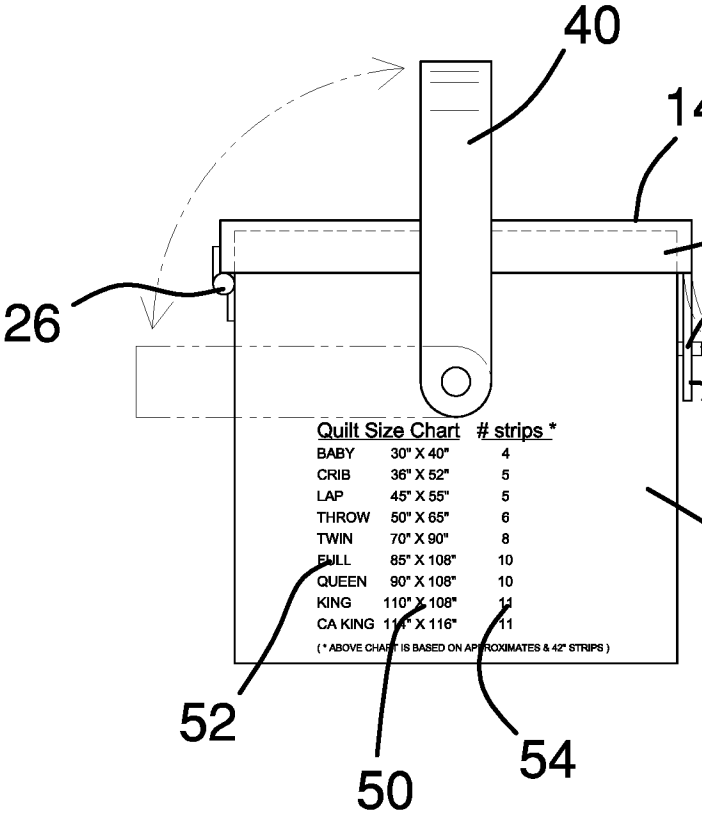
FIG. 4 is an end view of an embodiment of the disclosure.
Figure 6:
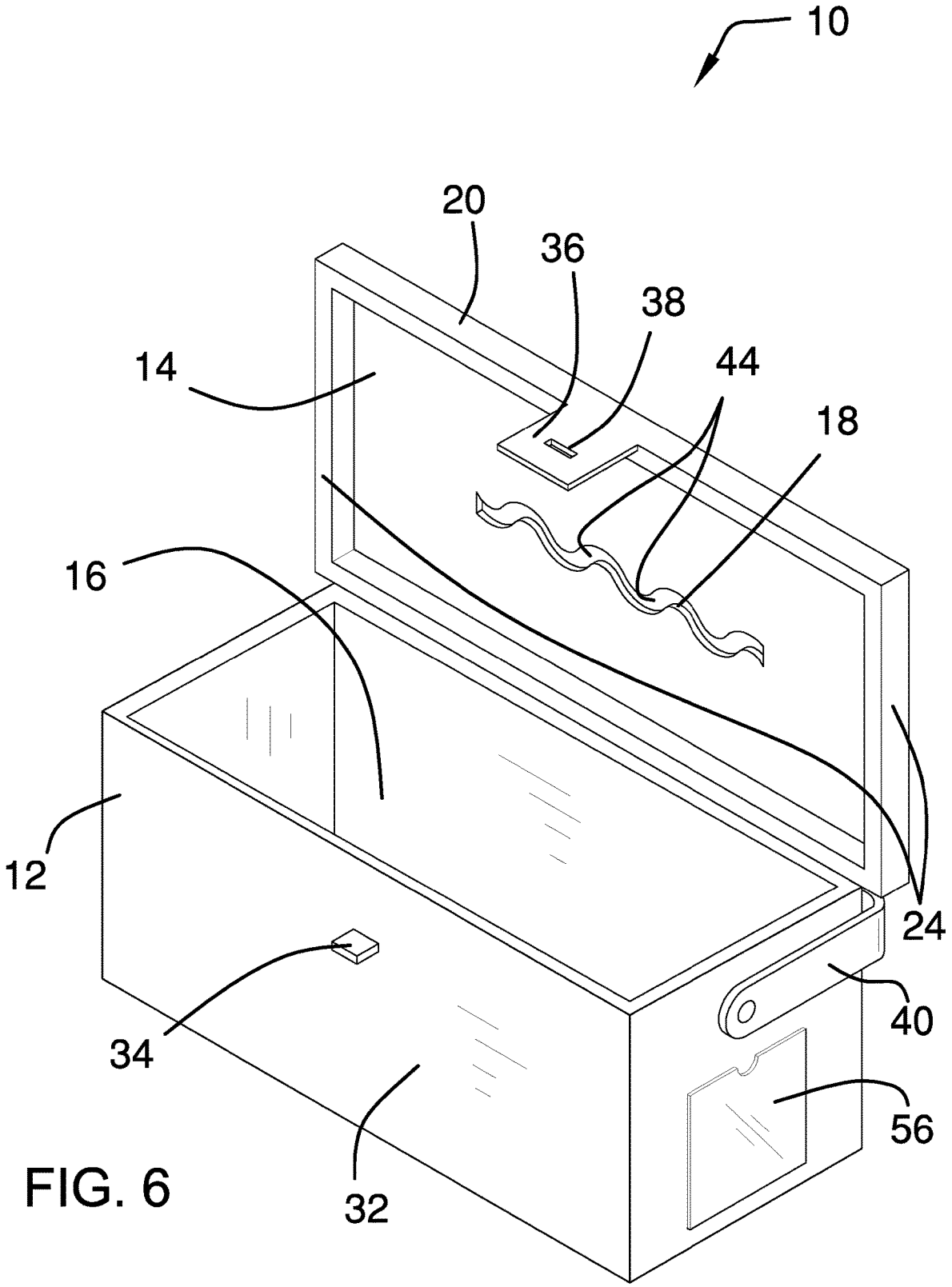
FIG. 6 is an open view of an embodiment of the disclosure.

A handle 40 is pivotally coupled to opposing ends 42 of the box 12, as shown in FIG. 4. The handle 40 is configured to be grasped in a hand of the user to lift the box 12 and the lid 14. The handle 40 is positioned to be pivoted relative the box 12, as shown in FIG. 5, positioning the user to pivot the lid 14 relative to the box 12 to open the top 16.

A plurality of grips 44 is coupled singly to each opposing limit 46 of each of the slots 18. The grips 44 are resiliently compressible. The grips 44 that are coupled to a respective slot 18 are configured to frictionally couple to an associated binding strip to retain the associated binding strip in an extended configuration. The grips 44 comprises at least one of rubber, silicon, and elastomer.

A chart 48 is coupled to a respective opposing end 42 of the box 12, as shown in FIG. 4. The chart 48 is configured to display a plurality of sets of dimensions 50, with each set of dimensions 50 corresponding to an associated quilt size 52, and an associated number of binding strips 54, each of which is typically 42 inches in length, that would be required to bind a quilt of the associated quilt size 52.

Figure 5:
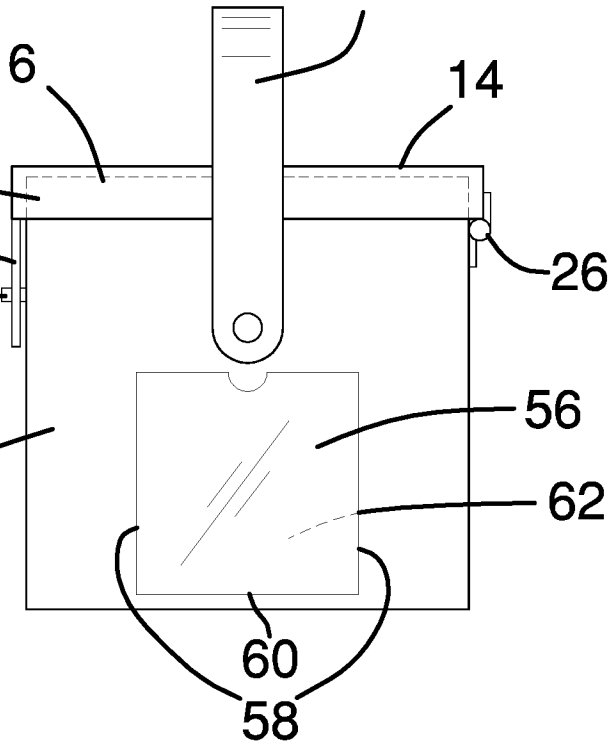
FIG. 5 is an end view of an embodiment of the disclosure.

A panel 56, which opposing side edges 58 and a lower edge 60 that are coupled to a respective opposing end 42 of the box 12, defines a pocket 62, as shown in FIG. 5. The panel 56 is substantially transparent so that the pocket 62 is configured for insertion an article, such as samples of the different binding strips that are positioned in the box 12, to couple the article to the box 12.

A ruler 64 that is coupled to the front 32 of the box 12 is configured to measure a respective binding strip. The ruler 64 measures seven inches in ⅛ inch increments. The ruler 64 is available to the user to measure a section of a final binding strip that is required to complete the binding of a respective quilt. The device 10 provides storage and organization for binding strips, and also brings together required measurement capability with the ruler 64 and size reference with the chart 48.

In use, the box 12 serves as a storage container for a plurality of binding strips required for binding quilts. The binding strips are positioned in the box 12 with a portion of each binding strip extending through the slot 18 that is positioned in the lid 14. The user then pulls a desired number of binding strips, or a desired length of a respective binding strip, through the slot 18 to complete the binding of a quilt.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded.

A reference to an element by the indefinite article "a" does not exclude the possibility that more than one of the elements is present, unless the context clearly requires that there be only one of the elements.

I claim:

1. A binding strip storing and dispensing device comprising:

a box having a top, the top being open wherein the top is configured for inserting a plurality of binding strips into the box;

a lid hingedly coupled to the box, the lid being selectively couplable to the box such that the lid is positioned for selectively closing the top for containing the binding strips;

a set of slots positioned in the lid wherein each slot is configured for extension of a respective binding strip from the lid; and a plurality of grips, the grips being coupled singly to each opposing limit of each of the slots, the grips being resiliently compressible wherein the grips coupled to a respective slot are configured for frictionally coupling to an associated binding strip for retaining the associated binding strip in an extended configuration.

2. The device of claim 1, further including a handle pivotally coupled to opposing ends of the box wherein the handle is configured for grasping in a hand of a user for lifting the box and the lid and such that the handle is positioned for pivoting relative the box positioning the user for pivoting the lid relative to the box for opening the top.

3. The device of claim 1, further including the grips comprising at least one of rubber, silicon, and elastomer.

4. The device of claim 1, further including the set of slots comprising a single slot positioned substantially equally distant from a forward edge and rearward edge of the lid wherein the slot is configured for extension of each binding strip of the plurality of binding strips.

5. The device of claim 4, further including the slot extending sinuously from proximate to opposing side edges of the lid.

6. The device of claim 1, further including a set of hinges, each hinge being coupled to and extending between the box and a rearward edge of the lid such that the lid is hingedly coupled to the box.

7. The device of claim 6, further including the set of hinges comprising two hinges.

8. The device of claim 1, further comprising:

a first fastener coupled to a forward edge of the lid; and a second fastener coupled to a front of the box, the second fastener being complementary to the first fastener such that the second fastener is positioned for selectively coupling to the first fastener for securing the lid to the box.

9. The device of claim 8, further including the second fastener comprising a protrusion, the first fastener comprising a tab and a hole, the tab being resiliently bendable, the hole being positioned in the tab, the hole being complementary to the protrusion, the tab being coupled to and extending from the forward edge wherein the tab is configured for bending such that the hole is positioned for selectively inserting the protrusion for securing the lid to the box.

10. A binding strip storing and dispensing device comprising:

a box having a top, the top being open wherein the top is configured for inserting a plurality of binding strips into the box;

a lid hingedly coupled to the box, the lid being selectively couplable to the box such that the lid is positioned for selectively closing the top for containing the binding strips;

a set of slots positioned in the lid wherein each slot is configured for extension of a respective binding strip from the lid; and a chart coupled to a respective opposing end of the box wherein the chart is configured for displaying a plurality of sets of dimensions, with each set of dimensions corresponding to an associated quilt size, and an associated number of binding strips required for binding a quilt of the associated quilt size.

11. The device of claim 10, further including a panel having opposing side edges and a lower edge coupled to a respective opposing end of the box defining a pocket, the panel being substantially transparent wherein the pocket is configured for insertion of an article for coupling the article to the box.

12. A binding strip storing and dispensing device comprising:

a box having a top, the top being open wherein the top is configured for inserting a plurality of binding strips into the box;

a lid hingedly coupled to the box, the lid being selectively couplable to the box such that the lid is positioned for selectively closing the top for containing the binding strips;

a set of slots positioned in the lid wherein each slot is configured for extension of a respective binding strip from the lid; and a ruler coupled to a front of the box wherein the ruler is configured for measuring a respective binding strip.

13. The device of claim 12, further including the ruler measuring seven inches in ⅛ inch increments.

14. The device of claim 12, further comprising:

the set of slots comprising a single slot positioned substantially equally distant from a forward edge and rearward edge of the lid wherein the slot is configured for extension of each binding strip of the plurality of binding strips, the slot extending sinuously from proximate to opposing side edges of the lid;

a set of hinges, each hinge being coupled to and extending between the box and the rearward edge of the lid such that the lid is hingedly coupled to the box, the set of hinges comprising two hinges;

a first fastener coupled to the forward edge of the lid;

a second fastener coupled to a front of the box, the second fastener being complementary to the first fastener such that the second fastener is positioned for selectively coupling to the first fastener for securing the lid to the box, the second fastener comprising a protrusion, the first fastener comprising a tab and a hole, the tab being resiliently bendable, the hole being positioned in the tab, the hole being complementary to the protrusion, the tab being coupled to and extending from the forward edge wherein the tab is configured for bending such that the hole is positioned for selectively inserting the protrusion for securing the lid to the box;

a handle pivotally coupled to opposing ends of the box wherein the handle is configured for grasping in a hand of a user for lifting the box and the lid and such that the handle is positioned for pivoting relative the box positioning the user for pivoting the lid relative to the box for opening the top;

a plurality of grips, the grips being coupled singly to each opposing limit of each of the slots, the grips being resiliently compressible wherein the grips coupled to a respective slot are configured for frictionally coupling to an associated binding strip for retaining the associated binding strip in an extended configuration, the grips comprising at least one of rubber, silicon, and elastomer;

a chart coupled to a respective opposing end of the box wherein the chart is configured for displaying a plurality of sets of dimensions, with each set of dimensions corresponding to an associated quilt size, and an associated number of binding strips required for binding a quilt of the associated quilt size;

a panel having opposing side edges and a lower edge coupled to a respective opposing end of the box defining a pocket, the panel being substantially transparent wherein the pocket is configured for insertion of an article for coupling the article to the box; and the ruler measuring seven inches in ⅛ inch increments.

* * * * *